US010308470B2

(12) United States Patent
Soga et al.

(10) Patent No.: US 10,308,470 B2
(45) Date of Patent: Jun. 4, 2019

(54) BLADE AND POST-PROCESSING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Naofumi Soga, Sunto Shizuoka (JP); Yasunobu Terao, Izunokuni Shizuoka (JP)

(73) Assignees: KABUHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/702,947

(22) Filed: Sep. 13, 2017

(65) Prior Publication Data

US 2019/0077627 A1 Mar. 14, 2019

(51) Int. Cl.
*B65H 37/06* (2006.01)
*B65H 45/16* (2006.01)

(52) U.S. Cl.
CPC ..... *B65H 45/164* (2013.01); *B65H 37/06* (2013.01); *B65H 2801/27* (2013.01)

(58) Field of Classification Search
CPC ..... B65H 45/164; B65H 37/06
USPC ..... 493/444, 445; 270/39.08
See application file for complete search history.

(56) References Cited

U.S. PATENT DOCUMENTS 1,693,147 A * 11/1928 King ..... B65H 45/18 270/45
2,176,815 A * 10/1939 Hirohashi ..... B26F 1/22 281/21.1
3,031,780 A * 5/1962 Fredholm ..... B65H 45/101 38/2
5,445,592 A * 8/1995 Richards ..... B26D 7/1854 493/437
6,074,332 A * 6/2000 Helmstadter ..... B65H 45/18 493/254
7,325,799 B2 * 2/2008 Watkiss ..... B65H 45/18 270/39.06
8,894,558 B2 * 11/2014 Matsuzaki ..... G03G 15/6538 270/32
8,915,490 B2 * 12/2014 Izumichi ..... B65H 39/00 270/32

* cited by examiner

*Primary Examiner* — Patrick H Mackey
(74) *Attorney, Agent, or Firm* — Amin, Turocy & Watson LLP

(57) ABSTRACT

Disclosed is a blade for a saddle folding unit that can saddle-fold a sheet. At the edge of a folding side of the sheet in the blade, a protrusion portion protruding in a pushing direction of the blade is provided.

19 Claims, 12 Drawing Sheets

BLADE AND POST-PROCESSING APPARATUS

FIELD

Embodiments described herein relate generally to a blade, a post-processing apparatus, and methods associated therewith.

BACKGROUND

A post-processing apparatus for post-processing a sheet carried from an image forming device (for example, an MFP) is known. The post-processing apparatus includes a processing unit for stapling or sorting the carried sheet. In addition, the post-processing apparatus includes a saddle folding unit that performs so-called saddle-folding, in which a plurality of sheets are bundled and folded in half. The saddle folding unit includes a blade capable of reciprocating so as to insert and remove a leading edge with respect to a nip portion of a pair of folding rollers. The blade enters a nip portion while pushing a central portion of a sheet into the nip portion between a pair of folding rollers.

However, in a case where the blade pushes the sheet into the nip portion, there is a possibility of slippage between the blade and the sheet. When undesired slippage occurs between the blade and the sheet, there is a possibility that the central portion of the sheet cannot be accurately pushed into the nip portion.

DETAILED DESCRIPTION

Figure 1:
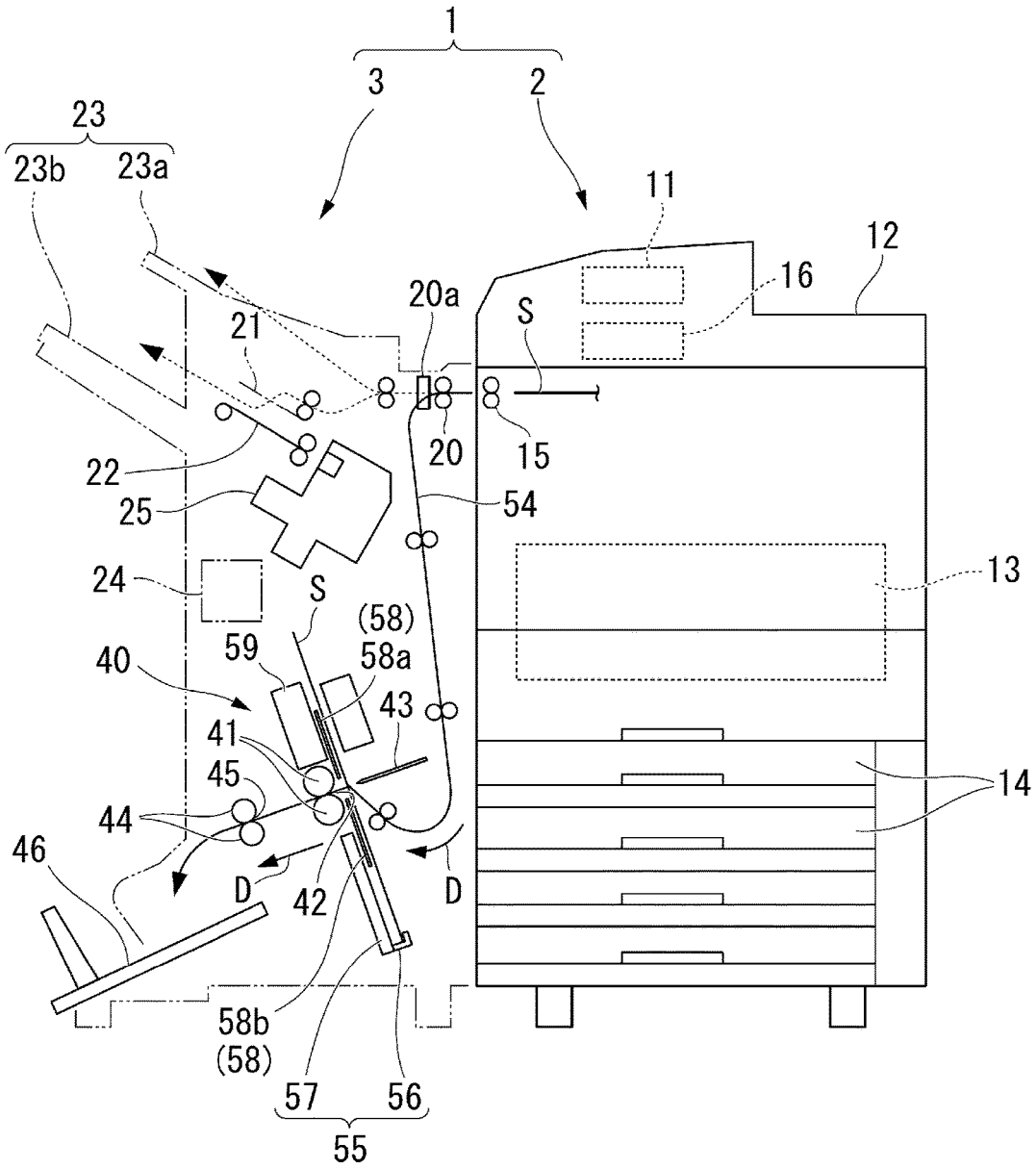
FIG. 1 is a view showing an example of an image forming system of an embodiment.

According to the embodiment, there is provided a blade for a saddle folding unit capable of saddle-folding a sheet. At the edge of a folding side of the sheet in the blade, a protrusion portion protruding in a pushing direction of the blade is provided.

Hereinafter, the post-processing apparatus of the embodiment will be described with reference to the drawings. In each drawing, the same reference numerals are assigned to the same components.

FIG. 1 is a view showing an example of an image forming system 1 of the embodiment.

As shown in FIG. 1, the image forming system 1 includes an image forming device 2 and a post-processing apparatus 3. The image forming device 2 forms an image on a sheet-like recording medium (hereinafter, referred to as a "sheet S") such as paper. For example, the image forming device 2 is a multifunction peripheral (MFP), a printer, a copying machine, or the like. The post-processing apparatus 3 performs post-processing on the sheet S carried from the image forming device 2. The sheet S is not limited to paper, but includes a plastic sheet such as an overhead projector (OHP) sheet. The sheet S is not limited to being sent from the image forming device 2 to the post-processing apparatus 3, but can also be sent by being fed manually to the post-processing apparatus 3. The image forming device 2 includes a control panel 11, a scanner unit 12, a printer unit 13, a paper feed unit 14, a paper discharge unit 15, and an image formation control unit 16.

The control panel 11 includes various keys or a touch panel for accepting an operation of a user. For example, the control panel 11 receives an input regarding a type of post-processing of the sheet S. The image forming device 2 sends information on the type of post-processing input by the control panel 11 to the post-processing apparatus 3.

The scanner unit 12 includes a reading unit that reads image information of an object to be copied. The scanner unit 12 sends the read image information to the printer unit 13.

The printer unit 13 forms an output image (hereinafter, referred to as a "toner image") with a developer such as a toner based on image information transmitted from the scanner unit 12 or an external device. The printer unit 13 transfers the toner image onto the surface of the sheet S. The printer unit 13 applies heat and pressure to the toner image transferred to the sheet S to fix the toner image on the sheet S.

The paper feed unit 14 supplies the sheets S one by one to the printer unit 13 in accordance with a timing at which the printer unit 13 forms a toner image.

The paper discharge unit 15 carries the sheet S discharged from the printer unit 13 to the post-processing apparatus 3.

The image formation control unit 16 controls the overall operation of the image forming device 2. That is, the image formation control unit 16 controls the control panel 11, the scanner unit 12, the printer unit 13, the paper feed unit 14, and the paper discharge unit 15. The image formation control unit 16 is formed of a control circuit including a Central Processing Unit (CPU), a Read Only Memory (ROM), and a Random Access Memory (RAM).

Next, the post-processing apparatus 3 will be described.

For example, the post-processing apparatus 3 is disposed adjacent to the image forming device 2. The sheet S is carried from the image forming device 2 to the post-processing apparatus 3. The post-processing apparatus 3 executes post-processing specified on the carried sheet S through the control panel 11. For example, the post-processing apparatus 3 performs stapling processing and sort processing. For example, the post-processing apparatus 3 performs sheet folding processing in which the sheet S is folded into two and carried out.

The post-processing apparatus 3 includes a loading unit 20, a standby unit 21, a processing unit 22, a carry-out unit 23, a post-processing control unit 24, and a saddle folding unit 40.

The loading unit 20 is connected to the downstream side of the paper discharge unit 15 in a carrying direction. The loading unit 20 receives the sheet S carried from the image forming device 2. A manual feed tray (not shown) is connected to the paper discharge unit 15.

The standby unit 21 temporarily retains (buffers) the sheet S carried from the image forming device 2. The standby unit 21 is provided above the processing unit 22. When the processing unit 22 is empty, the standby unit 21 causes the retained sheet S to fall toward the processing unit 22.

The processing unit 22 performs post-processing on the carried sheet S. For example, the processing unit 22 performs sorting processing in which a plurality of sheets S are sorted and aligned. For example, the processing unit 22 performs sheet binding processing on a sheet bundle in which a plurality of sheets S are sorted with staples or adhesive tapes. A reference numeral 25 in the drawing indicates a sheet binding apparatus which performs binding processing by stapling or the like on the sheet bundle in the processing unit 22. The processing unit 22 carries out the post-processed sheet S to the carry-out unit 23.

The carry-out unit 23 includes a fixed tray 23*a* and a movable tray 23*b*. The fixed tray 23*a* is provided on an upper portion of the post-processing apparatus 3. The movable tray 23*b* is provided on a side portion of the post-processing apparatus 3. The sheet S is discharged from the standby unit 21 and the processing unit 22 to the fixed tray 23*a* and the movable tray 23*b*.

The post-processing control unit 24 controls the overall operation of the post-processing apparatus 3. That is, the post-processing control unit 24 controls operations of the loading unit 20, the standby unit 21, the processing unit 22, the carry-out unit 23, and the saddle folding unit 40. Similarly, to the image formation control unit 16, the post-processing control unit 24 is formed of a control circuit including a CPU, a ROM, and a RAM.

Next, the saddle folding unit 40 of the post-processing apparatus 3 will be described.

The post-processing apparatus 3 includes the saddle folding unit 40 for folding (saddle-folding) one or a plurality of sheets S in half.

The post-processing apparatus 3 is shown along a path along a paper surface of FIG. 1. The front and back surfaces of the sheet S are arranged in parallel with a direction orthogonal to the paper surface in FIG. 1. Hereinafter, a direction along a carrying path of the sheet S in the saddle folding unit 40 is referred to as a sheet carrying direction D (or simply, a carrying direction). Hereinafter, the direction orthogonal to the paper surface in FIG. 1 is referred to as a sheet width direction W (see FIG. 2). The sheet S is in a rectangular shape having two sides along the sheet carrying direction D and two sides along the sheet width direction W.

The sheet S is carried from the image forming device 2 via a sheet path 54 to the saddle folding unit 40. The sheet S carried to the saddle folding unit 40 is received by a stacker 55.

For example, the stacker 55 receives the sent sheet S in an upright manner. The stacker 55 tilts the sheet S such that the upper side of the received sheet S is located on the downstream side in the carrying direction (a folding roller 41 side). In the case of folding the plurality of sheets S in half, the plurality of sheets S are sequentially stacked and received by the stacker 55 to become a bundle.

The sheet S (or the sheet bundle) received by the stacker 55 is supported by a guide member 58 from the downstream side in the carrying direction and arranged in a flat shape. At this time, a central portion SC (the center in the sheet carrying direction) of the sheet S in the upright direction faces a nip portion 42 of the folding roller 41 in a thickness direction of the sheet S (see FIG. 2). A folding blade 43 (hereinafter, simply referred to as a "blade 43") is disposed at a portion facing the nip portion 42 across the sheet S in the thickness direction of the sheet S.

Figure 2:
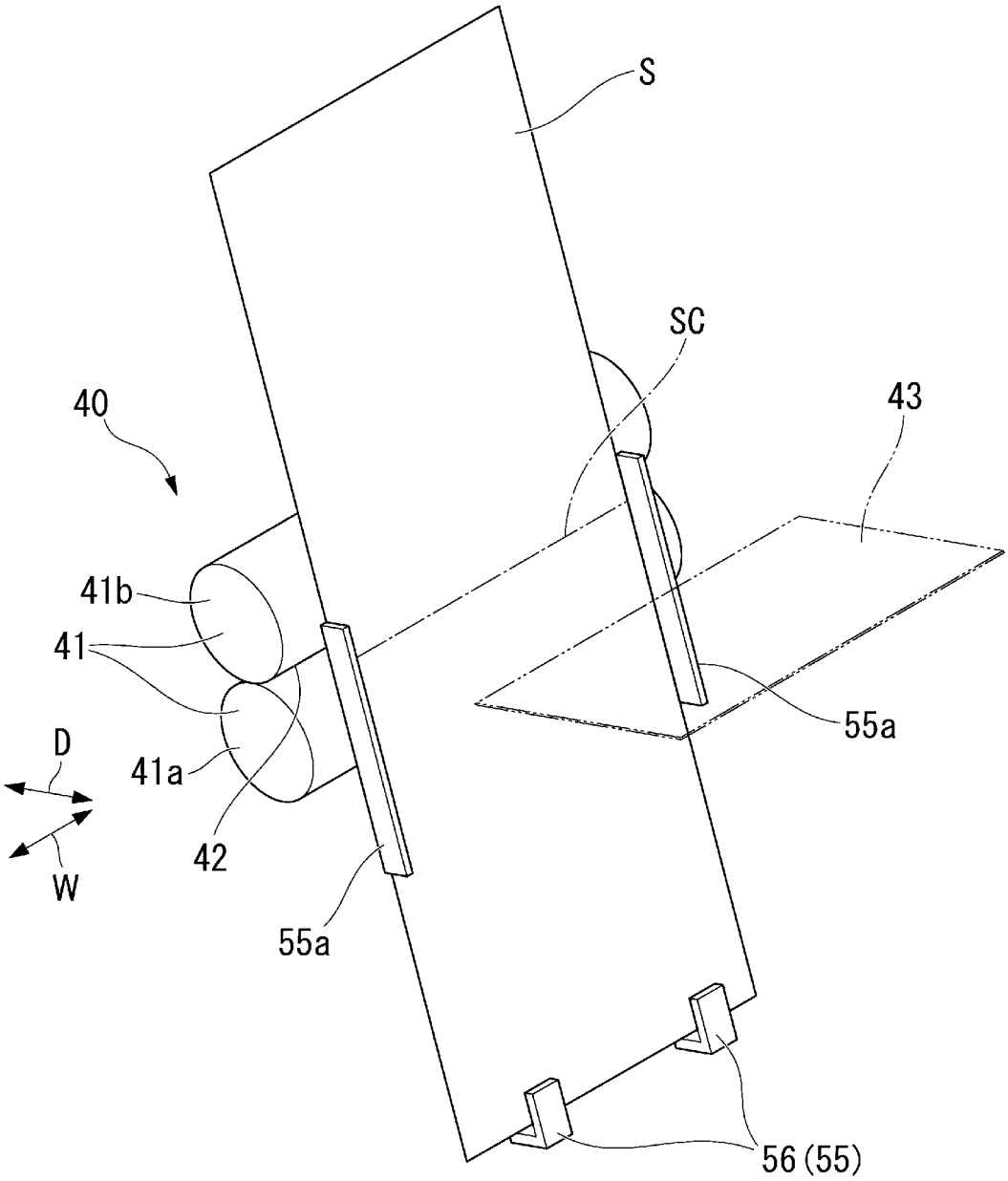
FIG. 2 is a perspective view showing an example of a saddle folding unit of a post-processing apparatus of the embodiment.

As shown in FIG. 2, the blade 43 pushes out the central portion SC in the upright direction of the sheet S toward the nip portion 42 of the folding roller 41 and pushes the central portion SC of the sheet S into the nip portion 42. The folding roller 41 rotates while pinching the central portion SC of the sheet S and folds the sheet S in half. As shown in FIG. 1, the folded sheet S (hereinafter, referred to as a "folded body") is carried by a discharge roller 44 located on the downstream side in the carrying direction of the nip portion 42 and discharged to a paper discharge tray 46. The folding roller and the discharge roller 44 are rotationally driven independently of each other or synchronously by a driving motor (not shown).

As shown in FIG. 1, a gate 20*a* is provided in the loading unit 20 of the post-processing apparatus 3 in order to switch whether to carry the sheet S carried from the image forming device 2 to the processing unit 22 side or the saddle folding unit 40 side. When the sheet folding processing is not performed, the gate 20*a* carries the sheet S carried from the image forming device 2 to the processing unit 22 side. The gate 20*a* carries the sheet S to the saddle folding unit 40 side when performing the sheet folding processing.

FIG. 2 is a perspective view showing an example of the saddle folding unit 40 of the post-processing apparatus 3 of the embodiment.

As shown in FIG. 2, the saddle folding unit 40 includes the folding roller 41 and the blade 43.

The folding roller 41 is composed of a pair of rollers forming the nip portion 42. One of the pair of rollers of the folding roller 41 is a driving roller 41*a*. The other of the pair of rollers of the folding roller 41 is a driven roller 41*b*.

The driving roller 41*a* is rotationally driven at a fixed position without moving. The driving roller 41*a* is driven by a driving source (not shown). For example, a DC motor is used as the driving source of the driving roller 41*a*. The driving source transmits a driving force to the driving roller 41*a*. For example, the driving source of the driving roller 41*a* also transmits the driving force to the blade 43.

The driven roller 41*b* is detachable with respect to the driving roller 41*a*. The driven roller 41*b* is energized towards the driving roller 41*a* by an energizing mechanism (not shown). The driven roller 41*b* rotates following the rotation of the driving roller 41*a*.

In the nip portion 42 of the folding roller 41, the central portion SC of the sheet S is pinched by the blade 43. The folding roller 41 folds the sheet S inserted into the nip portion 42 in half and carries the folded sheet S to the downstream side in the carrying direction.

The blade 43 is a plate-like member having a thickness in a direction in which the pair of rollers of the folding roller 41 faces to each other. The blade 43 can reciprocate so as to insert and remove the leading edge with respect to the nip portion 42. For example, the blade 43 reciprocates via a slider-crank mechanism. The blade 43 enters the nip portion 42 while pushing the central portion SC of the sheet S into the nip portion 42. The blade 43 retracts from the nip portion 42 while leaving the central portion SC of the sheet S in the nip portion 42.

As shown in FIG. 1, the guide member 58 is disposed between the folding roller 41 and the sheet S in the sheet carrying direction D. The guide member 58 is a plate member orthogonal to an advancing and retracting direction of the blade 43. The guide member 58 guides the sheet S carried from the sheet path 54 to an upright state and places the sheet S on the stacker 55. The guide member 58 is divided into a first guide member 58*a* and a second guide member 58*b* with a gap allowing the blade 43 to advance and retract. The blade 43 can advance through the gap between the first guide member 58*a* and the second guide member 58*b* and push the central portion SC (see FIG. 2) of the sheet S into the nip portion 42. When the central portion SC (see FIG. 2) of the sheet S is pushed into the nip portion 42, folding sides are formed on the sheet S. After forming the folding side on the sheet S, the blade 43 can retract and escape from the nip portion 42.

The stacker 55 includes a support claw 56 and a mobile device 57. The support claw 56 supports the lower end of the sheet S in the upright state. The mobile device 57 can move the support claw 56 up and down.

A stapling unit 59 is disposed above the stacker 55. According to the type of post-processing, the stapling unit 59 applies stapling processing to the central portion SC of the sheet S in advance. The sheet S placed on the stacker 55 can move up and down by the movement of the support claw 56. For example, even when the blade 43 pushes the sheet S into the nip portion 42, the support claw 56 also rises as the lower end of the sheet S is displaced. The sheet S placed on the stacker 55 is located (aligned) in the sheet carrying direction D by supporting the lower end of the sheet S on the support claw 56. As shown in FIG. 2, a pair of alignment members 55*a* for positioning the sheets S in the sheet width direction W are disposed on both sides of the stacker 55 in the sheet width direction.

As shown in FIG. 1, the discharge roller 44 that discharges the folded body toward the downstream side in the carrying direction is disposed at a portion that is separated downstream from the folding roller 41 in the carrying direction.

The discharge roller 44 is composed of a pair of rollers forming a nip portion 45. One of the pair of rollers of the discharge roller 44 is a driving roller. The other of the pair of rollers of the discharge roller 44 is a driven roller. The driving roller is rotationally driven at a fixed position without moving. The driven roller is detachable with respect to the driving roller. The driven roller is energized towards the driving roller by an energizing mechanism (not shown). In the nip portion 45 of the discharge roller 44, the folded body carried by the folding roller 41 is pinched. The discharge roller 44 carries the folded body inserted into the nip portion 45 to the downstream side in the carrying direction. The nip portion 45 of the discharge roller 44 faces the nip portion 42 of the folding roller 41 in the sheet carrying direction D.

Hereinafter, the blade 43 will be described in detail.

Figure 3:
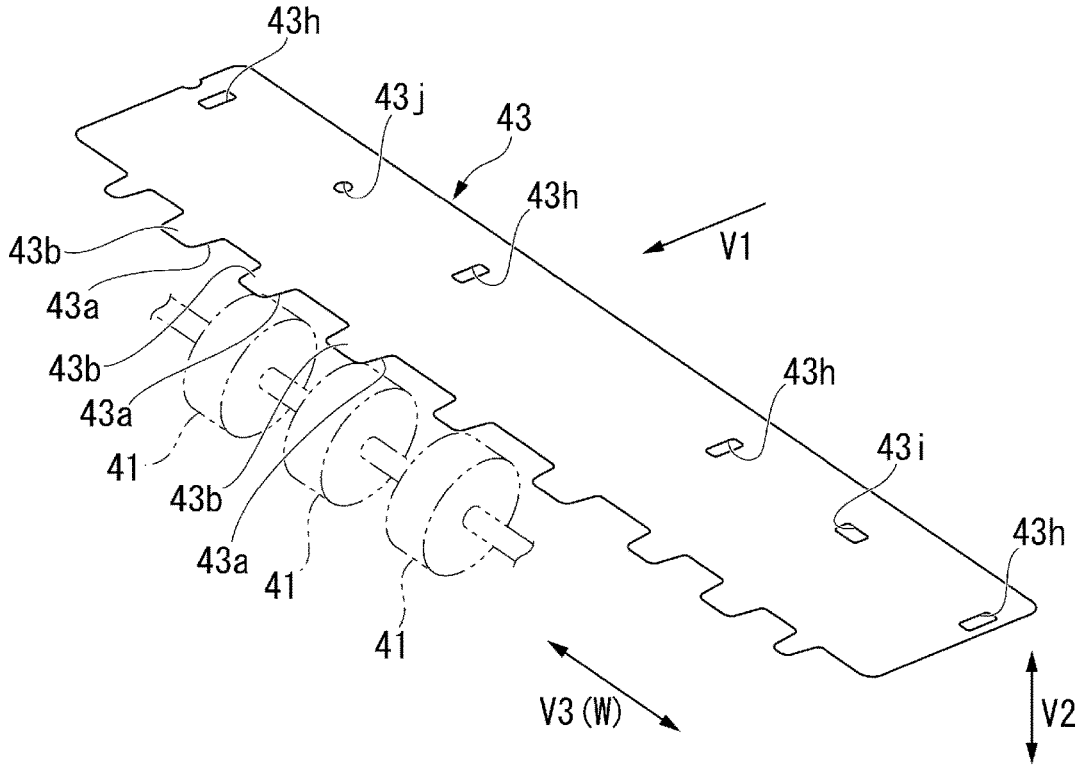
FIG. 3 is a perspective view showing an example of a blade of the embodiment.

FIG. 3 is a perspective view showing an example of the blade 43 of the embodiment.

As shown in FIG. 3, the blade 43 is a blade for the saddle folding unit 40 (see FIG. 2) capable of saddle-folding the sheet S. A plurality of concave portions 43*a* recessed so as to avoid the folding roller 41 are provided at the edge of a folding side (hereinafter, also referred to as a "leading edge") of the sheet S in the blade 43. The plurality of concave portions 43*a* are recessed on the side opposite to a pushing direction V1 of the blade 43. Here, the pushing direction V1 is a direction in which the blade 43 is directed toward the nip portion 42 (see FIG. 2) of the folding roller 41.

In other words, a plurality of pushing pieces 43*b* protruding in the pushing direction V1 of the blade 43 are provided at the leading edge of the blade 43. In the embodiment, a direction orthogonal to the pushing direction V1 and a thickness direction V2 of the blade 43 (hereinafter, also referred to as a "blade width direction V3") is parallel to the sheet width direction W. The plurality of pushing pieces 43*b* are arranged at intervals in the blade width direction V3. Reference numerals 43*h*, 43*i*, and 43*j* in the drawing indicates positioning holes or mounting holes of the blade 43 or the like.

Figure 4:
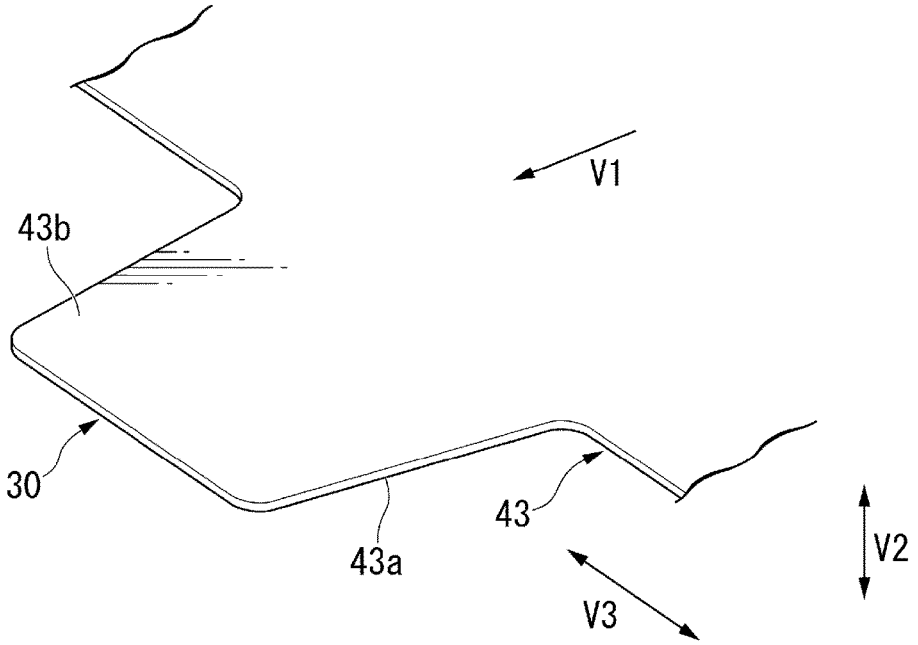
FIG. 4 is a perspective view showing an example of a leading edge of the blade of the embodiment.

FIG. 4 is a perspective view showing an example of the leading edge of the blade 43 of the embodiment.

As shown in FIG. 4, the pushing piece 43*b* is in a trapezoidal shape protruding in the pushing direction V1 of the blade 43. The length of the pushing piece 43*b* in the sheet width direction is shorter toward the nip portion 42 side (see FIG. 2) in the pushing direction V1 of the blade 43. A protrusion portion 30 protruding in the pushing direction V1 of the blade 43 is provided at the leading edge of the blade 43. The protrusion portion 30 is located at the end portion of the folding side of the sheet S of the pushing piece 43*b*. In the embodiment, the edge (the leading edge) of the folding side of the sheet S in the protrusion portion 30 has a linear shape continuous in the blade width direction V3 (the sheet width direction W).

Figure 5:
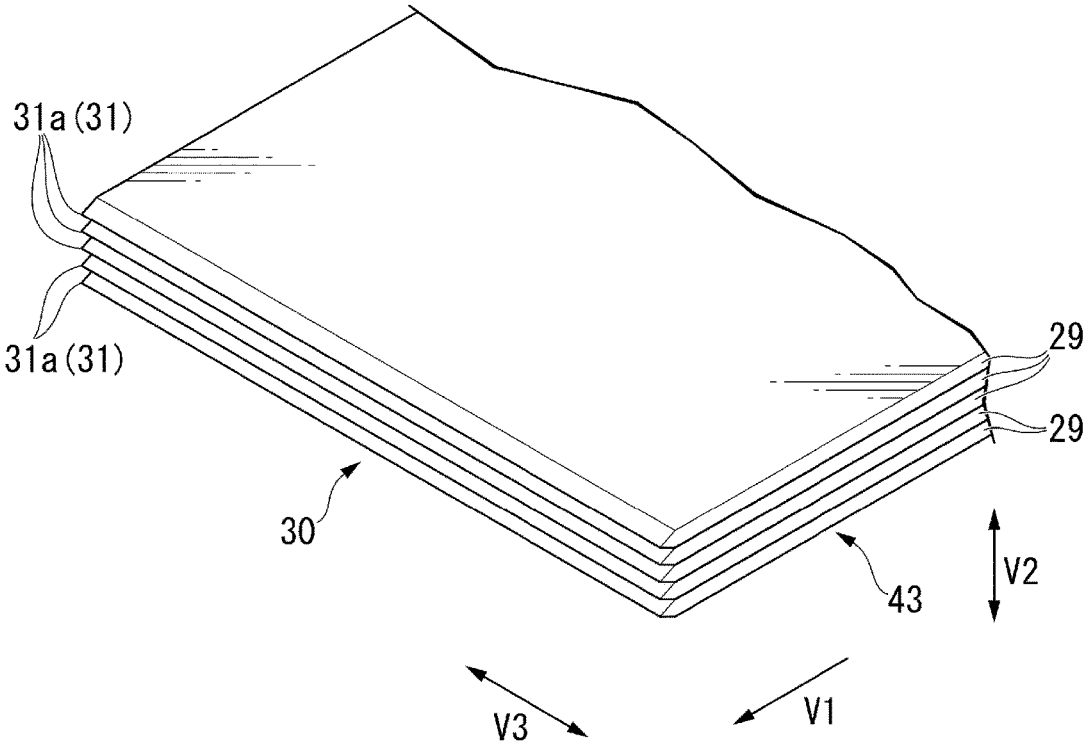
FIG. 5 is a perspective view showing an example of a protrusion portion of the blade of the embodiment.

FIG. 5 is a perspective view showing an example of the protrusion portion 30 of the blade 43 of the embodiment.

As shown in FIG. 5, the protrusion portion 30 includes a plurality of protrusions 31 aligned in the thickness direction V2 of the blade 43. In the embodiment, the protrusion portion 30 includes five protrusions 31 aligned in the thickness direction V2 of the blade 43. The blade 43 is a laminate in which a plurality of protrusion plates 29 having protrusions 31 are stacked in the thickness direction V2 of the blade 43. In the embodiment, the blade 43 is a laminate in which five protrusion plates 29 are stacked in the thickness direction V2 of the blade 43.

Figure 6:
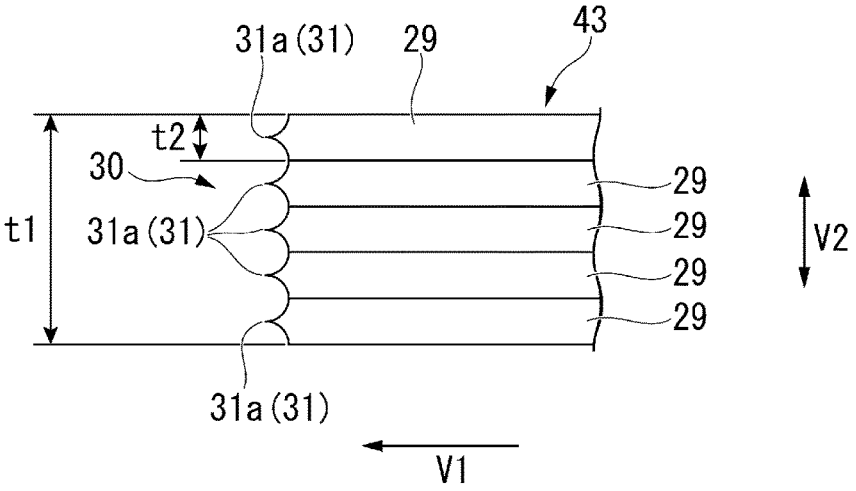
FIG. 6 is a side view showing an example of the protrusion portion of the blade of the embodiment.

FIG. 6 is a side view showing an example of the protrusion portion 30 of the blade 43 of the embodiment. In other words, FIG. 6 is a view of the protrusion portion 30 of the blade 43 as viewed from a direction (the blade width direction V3) orthogonal to the pushing direction V1 of the blade 43 and the thickness direction V2 of the blade 43.

As shown in FIG. 6, when viewed from the blade width direction V3, the protrusion ends 31*a* of the plurality of protrusions 31 are sorted over the entire thickness direction V2 of the blade 43. In other words, when viewed from the blade width direction V3, the protrusions 31 have the same amount of protrusion to the pushing direction V1. In the embodiment, the thickness of the five protrusion plates 29 is the same as each other.

In FIG. 6, a reference numeral t1 indicates the thickness of the blade 43, and a reference numeral t2 indicates the thickness of the protrusion plate 29. For example, the thickness t1 of the blade 43 is set within a range of 0.25 mm or more and 0.5 mm or less. For example, the thickness t2 of the protrusion plate 29 is set within a range of 0.05 mm or more and 0.1 mm or less. In the embodiment, the thickness t1 of the blade 43 is about 0.25 mm and the thickness t2 of the protrusion plate 29 is about 0.05 mm.

Figure 7:
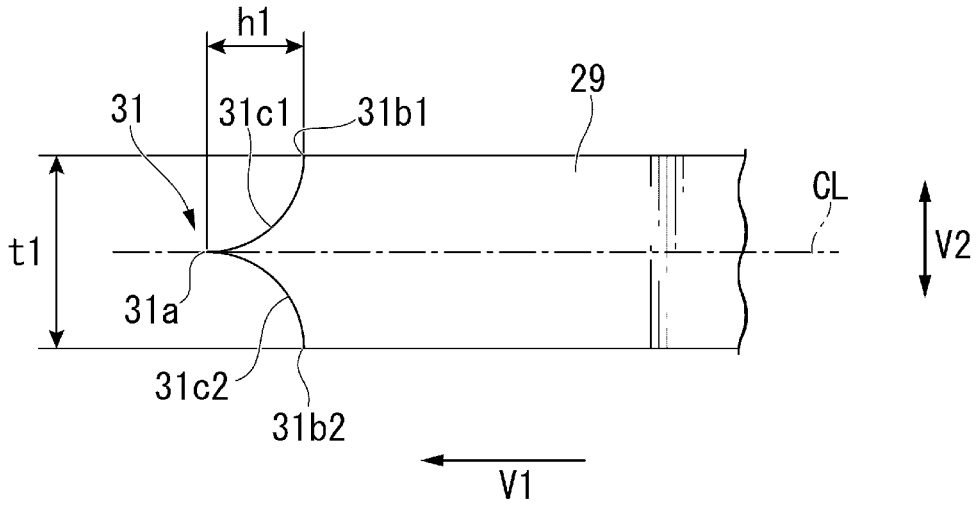
FIG. 7 is a side view showing an example of a protrusion of a protrusion plate of the embodiment.

FIG. 7 is a side view showing an example of the protrusion 31 of the protrusion plate 29 of the embodiment. In other words, FIG. 7 is a view of the protrusion 31 of the protrusion plate 29 as viewed from the blade width direction V3.

As shown in FIG. 7, when viewed from the blade width direction V3, the protrusion 31 protrudes to the pushing direction V1 toward a center side of the thickness direction V2.

In FIG. 7, a reference numeral 3*b*1 indicates a first base end of the protrusion 31, and a reference numeral 31*b*2 indicates a second base end of the protrusion 31, respectively. Here, the second base end 31*b*2 of the protrusion 31 is a base end of the protrusion 31 located on the side opposite to the first base end 3*b*1 of the protrusion 31 in the thickness direction V2. In the embodiment, the protrusion end 31*a* of the protrusion 31 is located at the center position in the thickness direction V2 of the blade 43. The protrusion 31 has a sharp shape protruding most in the pushing direction V1 at the center position in the thickness direction V2 of the blade 43.

In FIG. 7, a reference numeral 3*c*1 indicates a first surface located between the protrusion end 31*a* of the protrusion 31 and the first base end 3*b*1, and a reference numeral 31*c*2 indicates a second surface located between the protrusion end 31*a* of the protrusion 31 and the second base end 31*b*2, respectively. When viewed from the blade width direction V3, a first surface 3*c*1 and a second surface 31*c*2 have a circular arc-shaped convex toward the inside in the thickness direction V2 of the blade 43.

In FIG. 7, a reference numeral h1 indicates a protrusion amount of the protrusion 31. Here, the protrusion amount h1 of the protrusion 31 is equal to or greater than the distance between the protrusion end 31*a* of the protrusion 31 and the first base end 3*b*1 in the pushing direction V1. For example, there is a relationship of $h1 \geq 0.2 \times t2$ between the protrusion amount h1 of the protrusion 31 and the thickness t1 of the protrusion plate 29.

In FIG. 7, a reference numeral CL indicates a center axis of the protrusion plate 29 in the thickness direction V2. When viewed from the blade width direction V3, the protrusion plate 29 is axisymmetric with respect to the center axis CL of the protrusion plate 29 as an axis of symmetry. That is, when viewed from the blade width direction V3, the first surface 3*c*1 and the second surface 31*c*2 are axisymmetric with respect to the center axis CL of the protrusion plate 29 as an axis of symmetry.

Next, an example of a method of manufacturing the blade 43 of the embodiment will be described.

Figure 8:
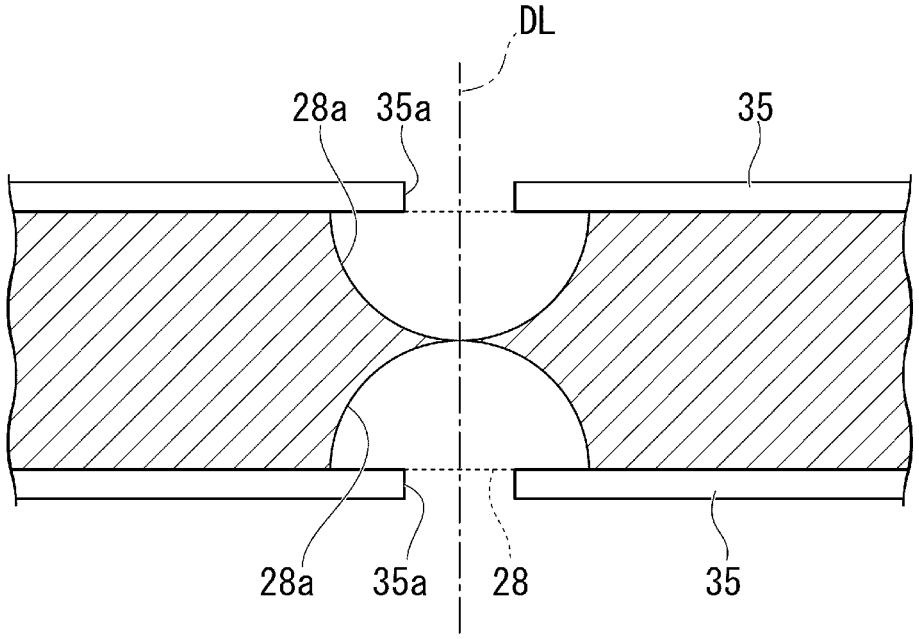
FIG. 8 is a diagram showing an example of a method of manufacturing the blade of the embodiment.

FIG. 8 is a view showing an example of a method of manufacturing the blade 43 of the embodiment. As shown in FIG. 8, first, a base plate 28 which is a plate member having a thickness of 0.05 mm or more and 0.1 mm or less is prepared.

Next, a pair of masks 35 with opening portions 35*a* on both sides of the base plate 28 are disposed. At this time, the opening portions 35*a* of the pair of masks 35 face to each other via the base plate 28.

Next, the base plate 28 is wet-etched via the opening portions 35*a* of the pair of masks 35. By performing wet-etching for a predetermined time, a pair of circular arc-shaped concave portions 28*a* are formed in the base plate 28. The pair of circular arc-shaped concave portions 28*a* are formed in a portion of the base plate 28 facing the opening portions 35*a* of the pair of masks 35.

When the pair of circular arc-shaped concave portions 28*a* are formed to have a predetermined depth, the base plate 28 is divided into right and left sides of the paper surface. A reference numeral DL in the drawing indicates a dividing line of the base plate 28 passing through the center of a pair of arc-shaped concave portions 28*a*. By dividing the base plate 28 having the pair of circular arc-shaped concave portions 28*a* formed to have the predetermined depth along a dividing line DL, the protrusion plate 29 (see FIG. 7) having the protrusions 31 is obtained.

Next, five protrusion plates 29 having protrusions 31 are stacked in the thickness direction V2. At this time, when viewed from the blade width direction V3, the protrusion ends 31*a* of the plurality of protrusions 31 are sorted over the entire thickness direction V2 of the blade 43.

Next, the five protrusion plates 29 are joined. For example, the five protrusion plates 29 are placed in a vacuum furnace and joined by applying pressure and heat. That is, the five protrusion plates 29 are integrated under vacuum thermo-compression. Through the above steps, the blade 43 (see FIG. 6) of the embodiment may be manufactured.

Next, an action of the blade 43 of the embodiment will be described.

Figure 9:
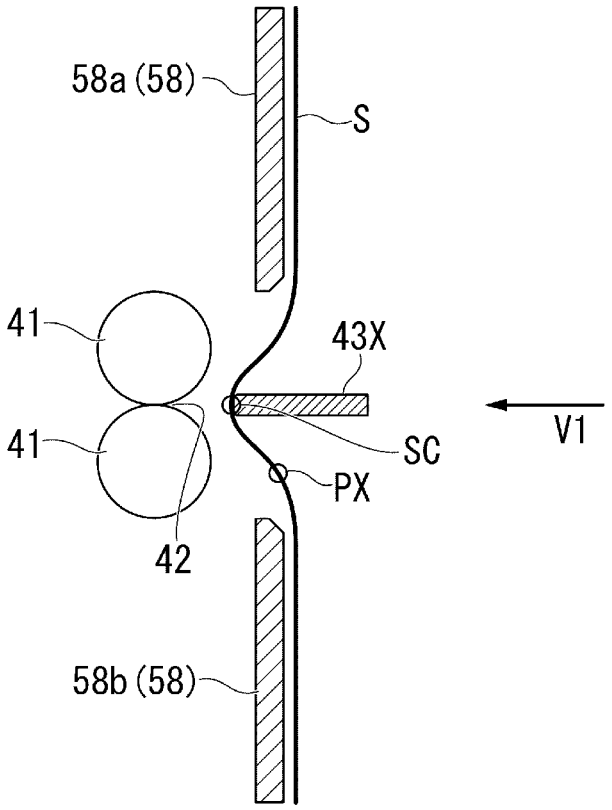
FIG. 9 is an explanatory view of an action of the blade in the embodiment.
Figure 10:
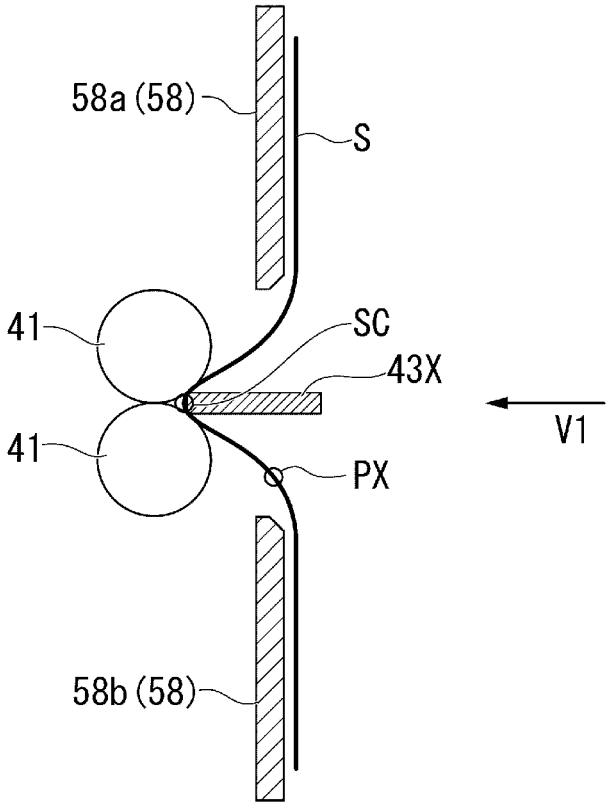
FIG. 10 is an explanatory view of an action of the blade in the embodiment, following FIG. 9.

FIGS. 9 and 10 are explanatory views of actions of the blade 43 (see FIG. 6) of the embodiment and the blade 43X of the comparative example. For convenience, in FIGS. 9 and 10, the illustration of the blade 43 of the embodiment will be omitted.

First, an action of the blade 43X of the comparative example will be described.

The blade 43X of the comparative example does not include the protrusion portion 30 in the embodiment. For example, when viewed from the blade width direction V3, the leading edge of the blade 43X of the comparative example has a flat surface parallel to one side of the sheet S.

As shown in FIG. 9, the blade 43X enters the nip portion 42 while pushing the central portion of the sheet S into the nip portion 42. However, in a case where the blade 43X pushes the sheet S into the nip portion 42, there is a possibility of slippage between the blade 43X and the sheet S. For example, factors causing slippage between the blade 43X and the sheet S include the self weight of the sheet S or the stiffness of the sheet S.

As shown in FIG. 10, when slippage occurs between the blade 43X and the sheet S, there is a possibility that the central portion of the sheet S cannot be accurately pushed into the nip portion 42. For example, when slippage occurs between the blade 43X and the sheet S due to the weight of the sheet S or the like, the central portion of the sheet S is displaced downwards from the blade 43X. In FIGS. 9 and 10, a reference numeral PX indicates the central portion of the sheet S which is displaced downwards from the blade 43X (the comparative example).

On the other hand, according to the embodiment, the blade 43 is a blade for the saddle folding unit 40 capable of saddle-folding the sheet S. The protrusion portion 30 protruding in the pushing direction V1 of the blade 43 is provided at the edge (the leading edge) of the folding side of the sheet S in the blade 43. With the above configuration, the following effects are achieved. In the blade 43 of the embodiment, a contact surface pressure of the blade 43 with respect to the sheet S is larger than that of the blade 43X having a flat surface at the leading edge. That is, the contact resistance between the sheet S and the blade 43 may be increased as compared with the blade 43X having a flat surface at the leading edge. According to the embodiment, in a case where the blade 43 pushes the sheet S into the nip portion 42, it is possible to prevent a push-in position of the blade 43 and the central portion of the sheet S from slipping in a vertical direction (gravity direction). Accordingly, it is possible to push the central portion of the sheet S accurately into the nip portion 42. In addition, it is possible to prevent a stapling position and a folding position from slipping from the sheet S. In FIGS. 9 and 10, a reference numeral SC indicates the central portion of the sheet S in the embodiment.

The protrusion portion 30 includes a plurality of protrusions 31 aligned in the thickness direction V2 of the blade 43, thereby achieving the following effects. Since the sheet S can be hooked by the plurality of protrusions 31, it is possible to more effectively prevent the push-in position of the blade 43 and the central portion of the sheet S from slipping in the vertical direction.

When viewed from the blade width direction V3, the protrusion 31 protrudes in the pushing direction V1 toward the center of the thickness direction V2, thereby achieving the following effects. By so-called double-side etching in which wet-etching is performed on both surfaces of the base plate 28, it is possible to easily manufacture the blade 43. In addition, in a case where the blade 43 is a laminate in which a plurality of the protrusion plates 29 are stacked in the thickness direction V2, the blade 43 can be stacked regardless of the vertical direction of the protrusion plate 29, which is preferable. That is, since the order of stacking of the protrusion plates 29 is irrelevant, it is possible to easily manufacture the blade 43.

The blade 43 is a laminate in which a plurality of protrusion plates 29 having protrusions 31 are stacked in the thickness direction V2, thereby achieving the following effects. Since the rigidity of the blade 43 can be increased as compared with the case where the blade 43 is formed of only one protrusion plate 29, it is possible to stably push the central portion of the sheet S into the nip portion 42.

The concave portion 43*a* recessed on the side opposite to the pushing direction V1 of the blade 43 is provided at the leading edge of the blade 43 so as to avoid the folding roller 41, thereby achieving the following effects. It is possible to increase the contact surface pressure of the blade 43 with respect to the sheet S as compared with the case where the leading edge of the blade 43 is formed in a linear shape continuous in the blade width direction V3. Accordingly, in a case where the blade 43 pushes the sheet S into the nip portion 42, it is possible to prevent a push-in position of the blade 43 and the central portion of the sheet S from slipping in the sheet width direction.

The post-processing apparatus 3 includes the blade 43 according to the embodiment, thereby achieving the following effects. It is possible to provide the post-processing apparatus 3 capable of accurately pushing the central portion of the sheet S into the nip portion 42.

Hereinafter, modification examples will be described.

First, the first modification example of the embodiment will be described.

When viewed the blade width direction V3, it is not limited that the protrusions 31 have the same amount of protrusion to the pushing direction V1.

Figure 11:
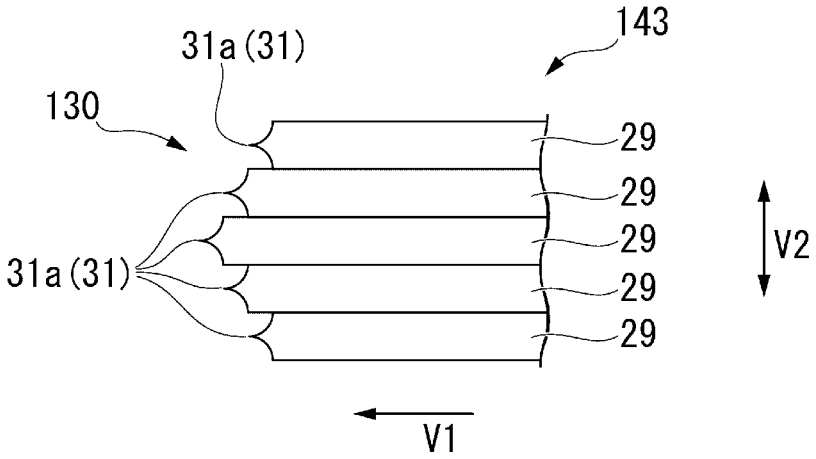
FIG. 11 is a side view showing an example of a protrusion portion of a blade of a first modification example of the embodiment.

FIG. 11 is a side view showing an example of a protrusion portion 130 of a blade 143 of the first modification example of the embodiment. FIG. 11 is the same as FIG. 6, respectively.

As shown in FIG. 11, when viewed from the blade width direction V3, the plurality of protrusions 31 may be disposed so that the protrusion amount in the pushing direction V1 becomes larger toward the center side in the thickness direction V2. In other words, the protrusion portion 130 may have a stepped shape in which the protrusion amount in the pushing direction V1 is larger toward the center side in the thickness direction V2.

According to the first modification example, since the sheet S can be positioned by the protrusions 31 located at the center of the thickness direction V2, it is possible to more effectively prevent the push-in position of the blade 143 and the central portion of the sheet S from slipping in the vertical direction.

Next, the second modification example of the embodiment will be described.

Figure 12:
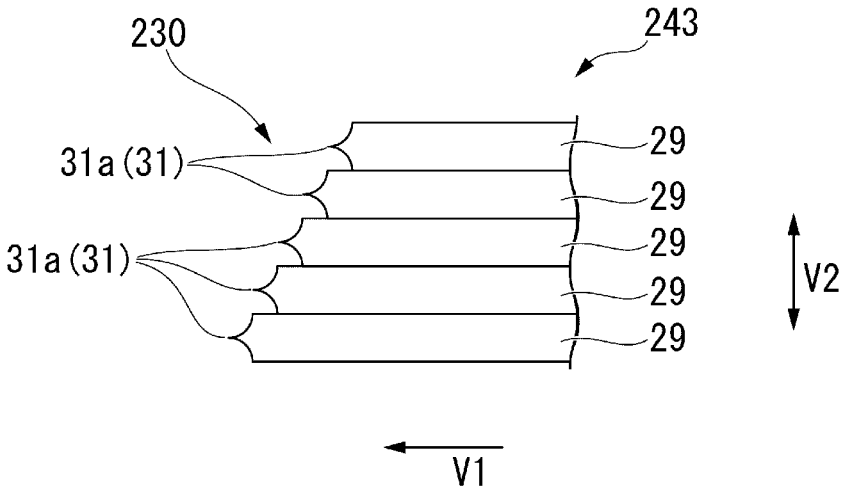
FIG. 12 is a side view showing an example of a protrusion portion of a blade of a second modification example of the embodiment.

FIG. 12 is a side view showing an example of a protrusion portion 230 of a blade 243 of the second modification example of the embodiment. FIG. 12 is the same as FIG. 6, respectively.

As shown in FIG. 12, when viewed from the blade width direction V3, the plurality of protrusions 31 may be disposed so that the protrusion amount in the pushing direction V1 becomes larger toward one side in the thickness direction V2. Specifically, when viewed from the blade width direction V3, the plurality of protrusions 31 may be disposed so that the protrusion amount in the pushing direction V1 becomes larger toward the lower side in the vertical direction.

According to the second modification example, it is possible to prevent the sheet S from slipping downwards in the vertical direction by the protrusions 31 located on the lower side in the vertical direction, thereby more effectively preventing the push-in position of the blade 243 and the central portion of the sheet S from slipping in the vertical direction.

Next, the third modification example of the embodiment will be described.

When viewed from the blade width direction V3, it is not limited that the protrusion 31 protrudes to the pushing direction V1 toward the center side of the thickness direction V2.

Figure 13:
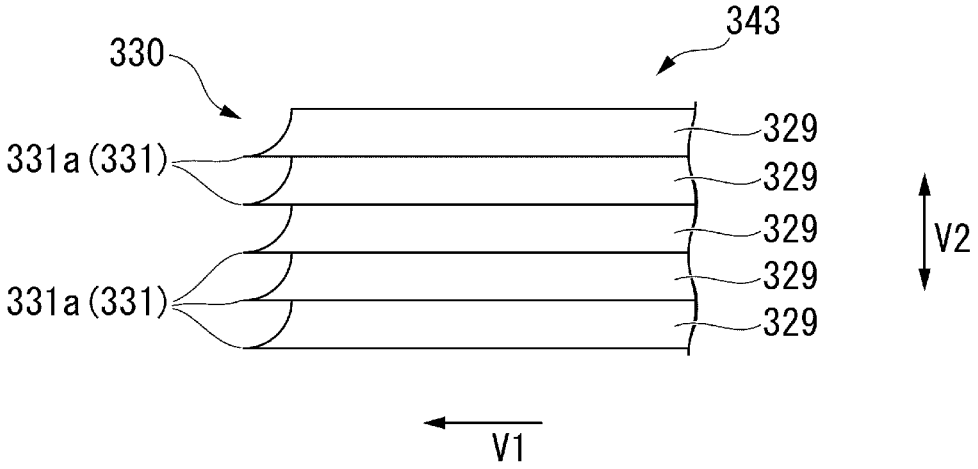
FIG. 13 is a side view showing an example of a protrusion portion of a blade of a third modification example of the embodiment.

FIG. 13 is a side view showing an example of a protrusion portion 330 of a blade 343 of the third modification example of the embodiment. FIG. 13 is the same as FIG. 6, respectively.

As shown in FIG. 13, when viewed from the blade width direction V3, a protrusion 331 may protrude to the pushing direction V1 toward one side of the thickness direction V2. When viewed from the blade width direction V3, the protrusion ends 331*a* of the plurality of protrusions 331 are sorted over the entire thickness direction V2 of the blade 343. In other words, when viewed from the blade width direction V3, the protrusions 331 have the same amount of protrusion to the pushing direction V1. In the present modification example, when viewed from the blade width direction V3, the protrusion end 331*a* of each protrusion 331 is located on one side in the thickness direction V2. The protrusion 331 has a sharp shape protruding most in the pushing direction V1 at one end position in the thickness direction V2 of the blade 343. A reference numeral 329 in the drawing indicates a protrusion plate having the protrusion 331.

Figure 14:
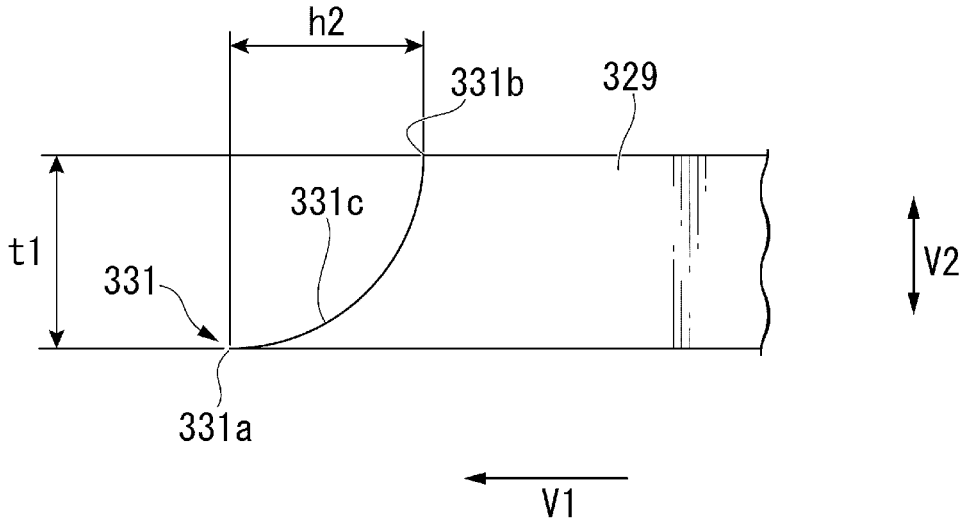
FIG. 14 is a side view showing an example of a protrusion of a protrusion plate of the third modification example of the embodiment.

FIG. 14 is a side view showing an example of the protrusion 331 of a protrusion plate 329 of the third modification example of the embodiment. FIG. 14 is the same as FIG. 7, respectively.

In FIG. 14, a reference numeral 331*b* indicates a base end of the protrusion 331. In the present modification example, the protrusion end 331*a* of the protrusion 331 is located at one end in the thickness direction V2 of the blade 343 (see FIG. 13).

In FIG. 14, a reference numeral 331*c* indicates a continuous surface located between the protrusion end 331*a* and the base end 331*b* of the protrusion 331. When viewed from the blade width direction V3, a continuous surface 331*c* has a circular arc-shaped convex toward the inside in the thickness direction V2 of the blade 343.

In FIG. 14, a reference numeral h2 indicates a protrusion amount of the protrusion 331. Here, the protrusion amount h2 of the protrusion 331 is the distance between the protrusion end 331*a* of the protrusion 331 and the base end 331*b* in the pushing direction V1. For example, there is a relationship of h2=0.4×t2 between the protrusion amount h2 of the protrusion 331 and the thickness t1 of the protrusion plate 329.

Next, an example of a method of manufacturing the blade 343 of the present modification example will be described.

Figure 15:
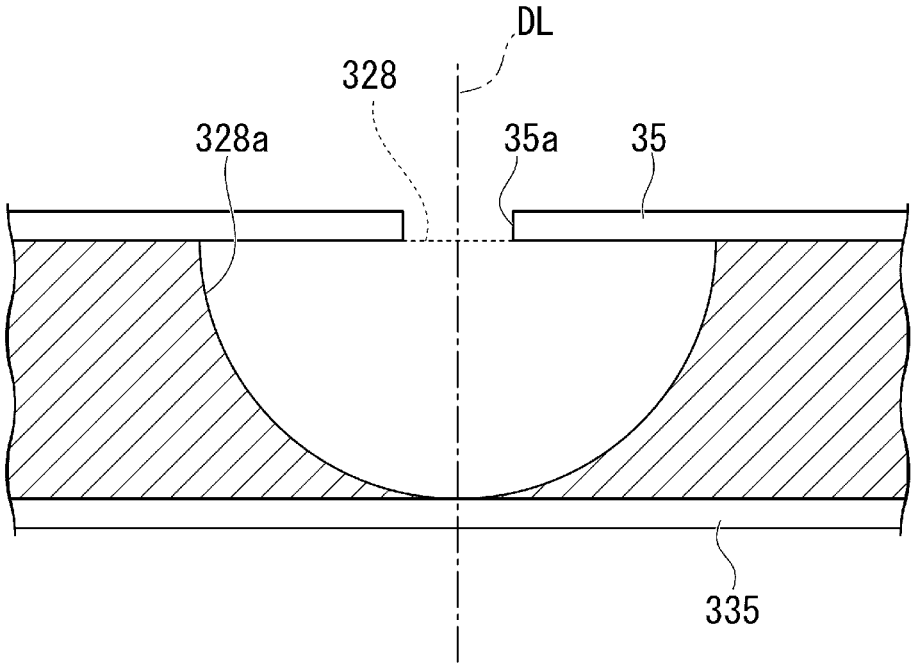
FIG. 15 is a diagram showing an example of a manufacturing method of the blade of the third modification example of the embodiment.

FIG. 15 is a view showing an example of a method of manufacturing the blade 343 of the third modification example of the embodiment.

As shown in FIG. 15, first, a base plate 328 which is a plate member having a thickness of 0.05 mm or more and 0.1 mm or less is prepared.

Next, the mask 35 with opening portion 35*a* on one side of the base plate 328 is disposed. On the other hand, a mask 335 having no opening portion is disposed on the other side of the base plate 28.

Next, the base plate 328 is wet-etched via the opening portion 35*a* of the mask 35. By performing wet-etching for a predetermined time, a circular arc-shaped concave portion 328*a* is formed in a portion facing the opening portion 35*a* of the mask 35 in the base plate 328.

When circular arc-shaped concave portions 328*a* are formed to have a predetermined depth, the base plate 328 is divided into right and left sides of the paper surface. The reference numeral DL in the drawing indicates a dividing line of the base plate 328 passing through the center of arc-shaped concave portion 328*a*. By dividing the base plate 328 having the circular arc-shaped concave portions 328*a* formed to have a predetermined depth along the dividing line DL, the protrusion plate 329 (see FIG. 14) having the protrusions 331 is obtained.

Next, five protrusion plates 329 having protrusions 331 are stacked in the thickness direction V2. At this time, when viewed from the blade width direction V3, the protrusion ends 331*a* of the plurality of protrusions 331 are sorted over the entire thickness direction V2 of the blade 343.

Next, the five protrusion plates 329 are joined. For example, the five protrusion plates 329 are placed in a vacuum furnace and joined by applying pressure and heat. That is, the five protrusion plates 329 are integrated under vacuum thermo-compression. Through the above steps, the blade 343 (see FIG. 13) of the present modification example may be manufactured.

According to the third modification example, by so-called single-side etching in which wet-etching is performed on a single surface of the base plate 328, it is possible to easily manufacture the blade 343.

Next, the fourth modification example of the embodiment will be described.

When viewed from the blade width direction V3, it is not limited that the protrusion end 331*a* of each protrusion 331 is located on one side in the thickness direction V2.

Figure 16:
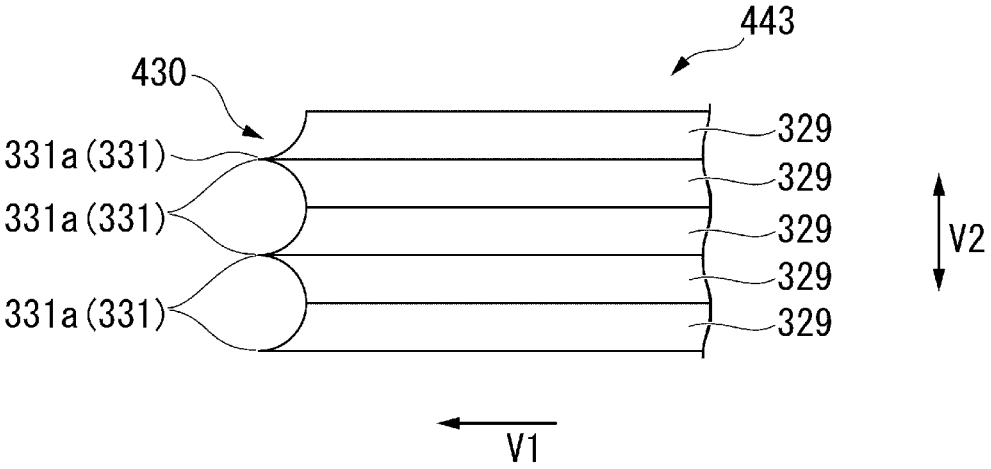
FIG. 16 is a side view showing an example of a protrusion portion of a blade of a fourth modification example of the embodiment.

FIG. 16 is a side view showing an example of a protrusion portion 430 of a blade 443 of the fourth modification example of the embodiment. FIG. 16 is the same as FIG. 6, respectively.

As shown in FIG. 16, the protrusion end 331*a* of each protrusion 331 may be alternately disposed on one side and the other side in the thickness direction V2 of the blade 443. In other words, in the blade 443, protrusion ends 331*a* of two protrusions 331 adjacent to each other in the thickness direction V2 may be connected to each other.

According to the fourth modification example, it is possible to increase the rigidity of the two protrusions 331 adjacent to each other in the thickness direction V2 compared with the case where the protrusion ends 331*a* of the plurality of protrusions 331 are separated in the thickness direction V2.

Next, the fifth modification example of the embodiment will be described.

When viewed from the blade width direction V3, it is not limited that the first surface 3*c*1 and the second surface 31*c*2 of the protrusion 31 have a circular arc-shaped convex toward the inside in the thickness direction V2 of the blade 43.

Figure 17:
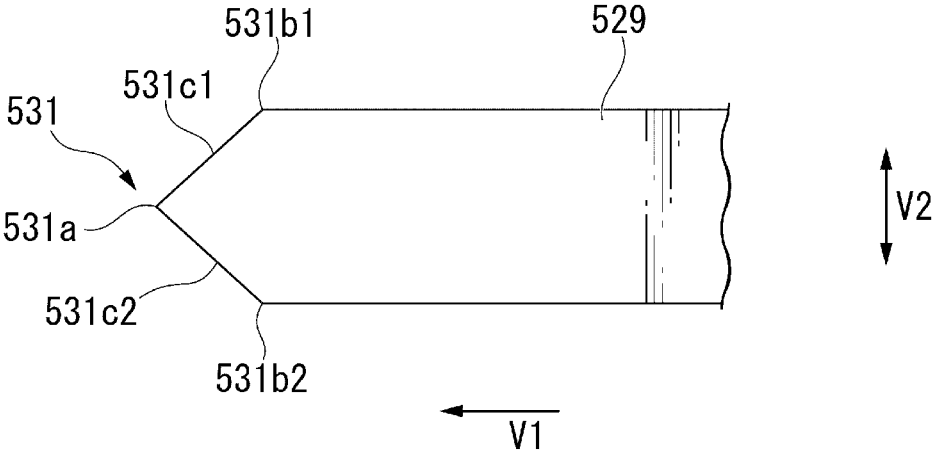
FIG. 17 is a side view showing an example of a protrusion of a protrusion plate of a fifth modification example of the embodiment.

FIG. 17 is a side view showing an example of a protrusion 531 of a protrusion plate 529 of the fifth modification example of the embodiment. FIG. 17 is the same as FIG. 7, respectively.

As shown in FIG. 17, when viewed from the blade width direction V3, a first surface 53*c*1 of the protrusion 531 may have a linear shape inclined from the protrusion end 531*a* toward a first base end 53*b*1. When viewed from the blade width direction V3, a second surface 531*c*2 of the protrusion 531 may have a linear shape inclined from the protrusion end 531*a* toward a second base end 531*b*2. That is, when viewed from the blade width direction V3, the protrusion 531 may have an isosceles triangle shape convex in the pushing direction V1.

Next, the sixth modification example of the embodiment will be described.

When viewed from the blade width direction V3, it is not limited that the continuous surface 331*c* of the protrusion 331 has a circular arc-shaped convex toward the inside in the thickness direction V2 of the blade 343.

Figure 18:
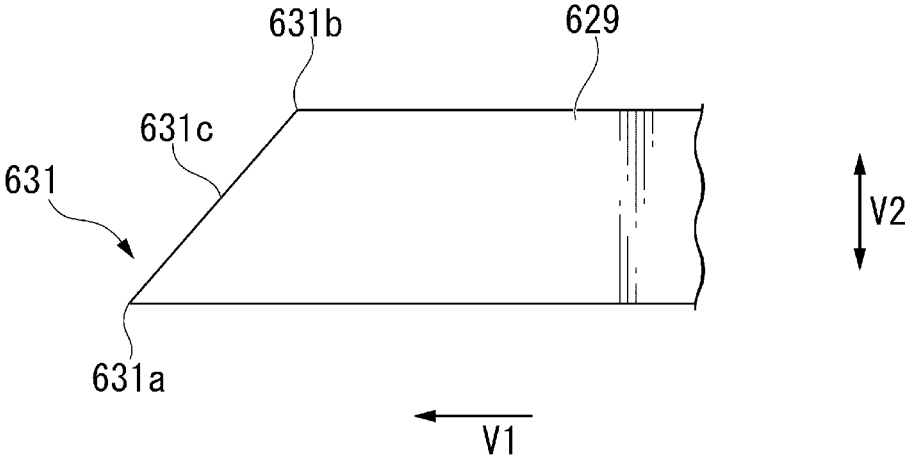
FIG. 18 is a side view showing an example of a protrusion of a protrusion plate of a sixth modification example of the embodiment.

FIG. 18 is a side view showing an example of a protrusion 631 of a protrusion plate 629 of the sixth modification example of the embodiment. FIG. 18 is the same as FIG. 7, respectively.

As shown in FIG. 18, when viewed from the blade width direction V3, a continuous surface 631*c* of the protrusion 631 may have a linear shape inclined from the protrusion end 631*a* toward a base end 631*b*. That is, when viewed from the blade width direction V3, the protrusion 631 may have a right triangle shape convex in the pushing direction V1.

Next, the seventh modification example of the embodiment will be described.

It is not limited that the leading edge of the protrusion portion 30 has a linear shape continuous in the blade width direction V3.

Figure 19:
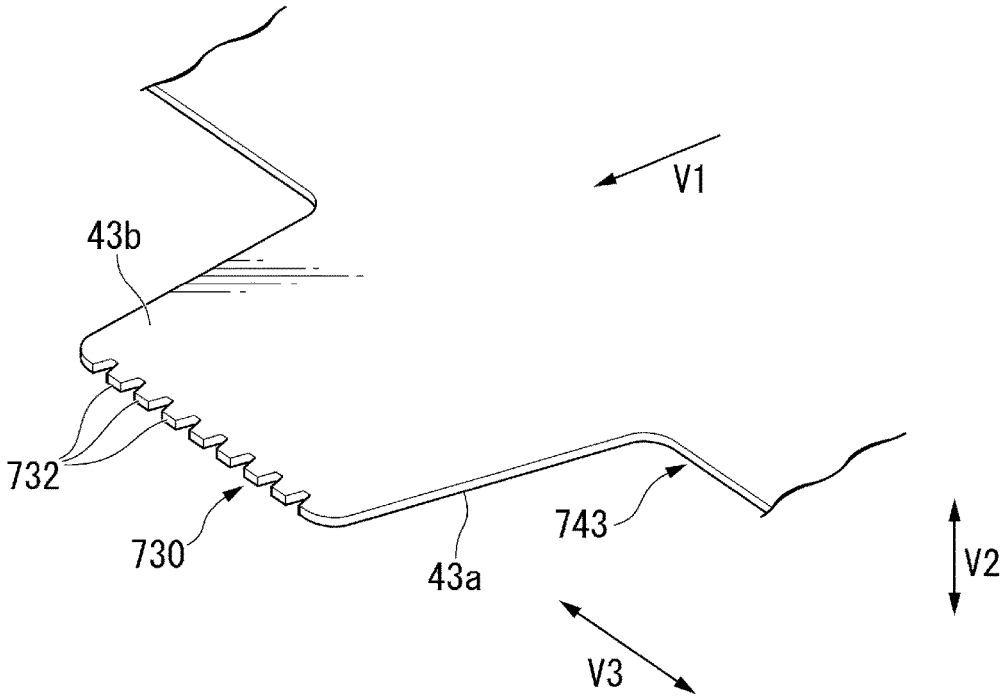
FIG. 19 is a perspective view showing an example of a protrusion portion of a blade of a seventh modification example of the embodiment.

FIG. 19 is a perspective view showing an example of a protrusion portion 730 of a blade 743 of the seventh modification example of the embodiment. FIG. 19 is the same as FIG. 4, respectively.

As shown in FIG. 19, the leading edge of the protrusion portion 730 may have a concave-convex (zigzag shape) in the blade width direction V3. Specifically, a plurality of convex portions 732 protruding in the pushing direction V1, and aligned in the blade width direction V3 may be provided at the leading edge of the protrusion portion 730.

According to the seventh modification example, it is possible to increase the contact surface pressure of the blade 743 with respect to the sheet S as compared with the case where the leading edge of the protrusion portion 30 is formed in a linear shape continuous in the blade width direction V3. Accordingly, in a case where the blade 743 pushes the sheet S into the nip portion 42, it is possible to prevent a push-in position of the blade 743 and the central portion of the sheet S from slipping in the sheet width direction.

Next, the eighth modification example of the embodiment will be described.

Figure 20:
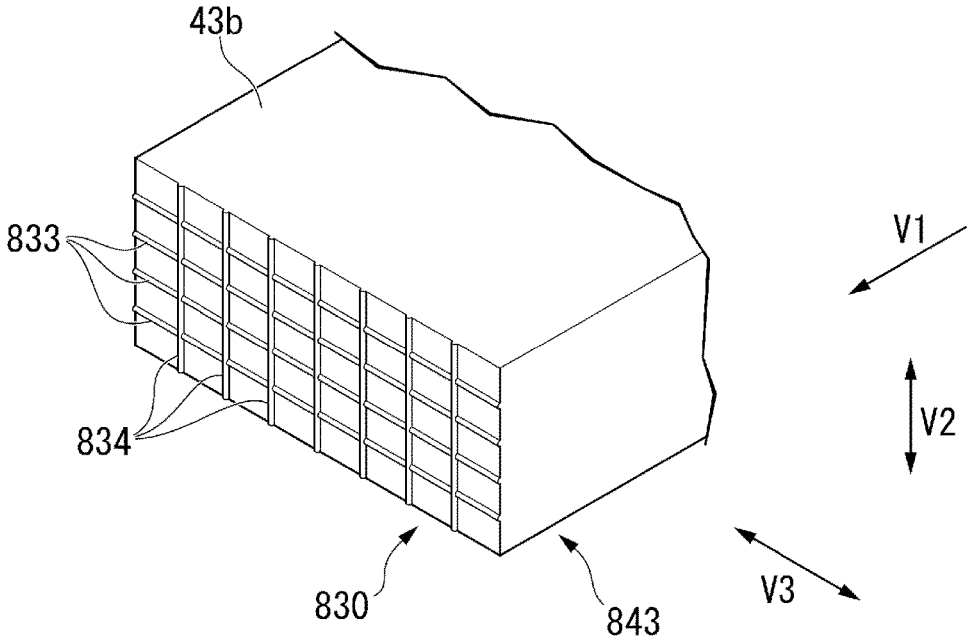
FIG. 20 is a perspective view showing an example of a protrusion portion of a blade of an eighth modification example of the embodiment.

FIG. 20 is a perspective view showing an example of a protrusion portion 830 of a blade 843 of the eighth modification example of the embodiment.

As shown in FIG. 20, the leading edge of the protrusion portion 830 may have a lattice shape. Specifically, the leading edge of the protrusion portion 830 may have a mesh shape having a plurality of first line portions 833 forming a linear shape parallel to the blade width direction V3 and a plurality of second line portions 834 forming a linear shape orthogonal to the first line portions 833.

According to the eighth modification example, it is possible to increase the contact surface pressure of the blade 843 with respect to the sheet S as compared with the case where the leading edge of the protrusion portion 30 is formed in a linear shape continuous in the blade width direction V3. Accordingly, in a case where the blade 843 pushes the sheet S into the nip portion 42, it is possible to prevent a push-in position of the blade 843 and the central portion of the sheet S from slipping in the sheet width direction.

Next, the ninth example of the embodiment will be described.

Figure 21:
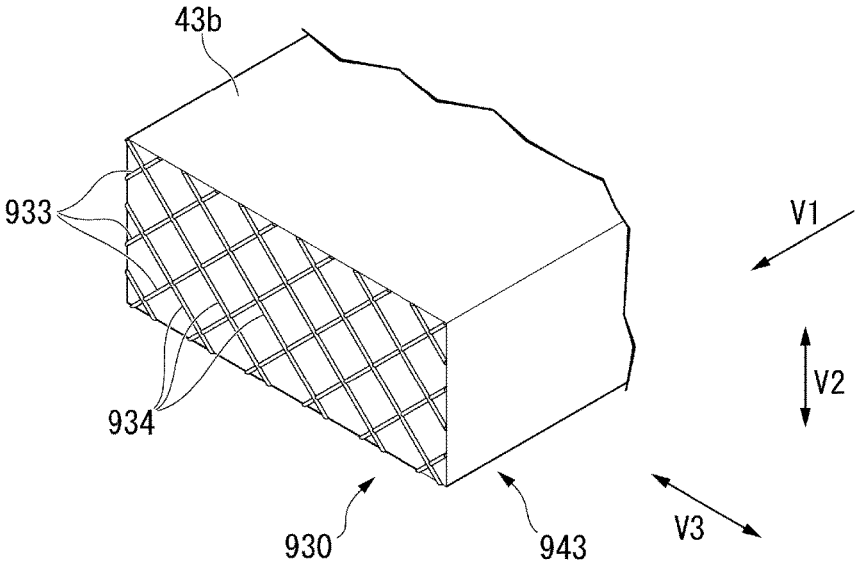
FIG. 21 is a perspective view showing an example of a protrusion portion of a blade of a ninth modification example of the embodiment.

FIG. 21 is a perspective view showing an example of a protrusion portion 930 of a blade 943 of the ninth modification example of the embodiment.

As shown in FIG. 21, the leading edge of the protrusion portion 930 may have a mesh shape having a plurality of first line portions 933 forming a linear shape intersecting the blade width direction V3 and a plurality of second line portions 934 forming a linear shape orthogonal to the first line portions 933.

According to the ninth modification example, it is possible to increase the contact surface pressure of the blade 943 with respect to the sheet S as compared with the case where the leading edge of the protrusion portion 30 is formed in a linear shape continuous in the blade width direction V3. Accordingly, in a case where the blade 943 pushes the sheet S into the nip portion 42, it is possible to prevent a push-in position of the blade 943 and the central portion of the sheet S from slipping in the sheet width direction.

Next, another modification example of the embodiment will be described.

It is not limited that the protrusion portion 30 includes five protrusions 31 aligned in the thickness direction V2 of the blade 43. For example, the protrusion portion 30 may have only one protrusion 31. Alternately, the protrusion portion 30 may include a plurality of protrusions 31 that are two or more and four or less that are aligned in the thickness direction V2 of the blade 43. In addition, the protrusion portion 30 may include a plurality of protrusions 31 that are six or more that are aligned in the thickness direction V2 of the blade 43.

It is not limited that the blade 43 is a laminate in which five protrusion plates 29 are stacked in the thickness direction V2 of the blade 43. For example, the blade 43 may have only one protrusion plate 29. Alternatively, the blade 43 may be a laminate in which two to four or six or more of the protrusion plates 29 are stacked in the thickness direction V2 of the blade 43.

It is not limited that the protrusion portion 30 is formed by wet etching the base plate 28. For example, the protrusion portion 30 may be formed by cutting the base plate 28.

It is not limited that the protrusion portion 30 is provided only at the leading edge of the blade 43. For example, the protrusion portion 30 may be provided over the entire outer peripheral edge of the blade 43.

According to at least one embodiment described above, the blade 43 is a blade for the saddle folding unit 40 capable of saddle-folding the sheet S. The protrusion portion 30 protruding in the pushing direction V1 of the blade 43 is provided at the edge (the leading edge) of the folding side of the sheet S in the blade 43. With the above configuration, the following effects are achieved. In the blade 43 of the embodiment, a contact surface pressure of the blade 43 with respect to the sheet S is larger than that of the blade 43X having a flat surface at the leading edge. That is, the contact resistance between the sheet S and the blade 43 may be increased as compared with the blade 43X having a flat surface at the leading edge. According to the embodiment, in a case where the blade 43 pushes the sheet S into the nip portion 42, it is possible to prevent a push-in position of the blade 43 and the central portion of the sheet S from slipping in a vertical direction (gravity direction). Accordingly, it is possible to push the central portion of the sheet S accurately into the nip portion 42.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A blade for a saddle folding unit that facilitates saddle-folding a sheet, the blade comprising:

a protrusion portion that protrudes in a pushing direction of the blade on an edge of a folding side of the sheet in the blade, wherein the protrusion portion comprises a plurality of protrusions aligned in a thickness direction of the blade, wherein the protrusions protrude in the pushing direction, the protrusions being closer together toward a center side in the thickness direction when viewed from a direction orthogonal to the pushing direction and the thickness direction.

2. The blade according to claim 1, wherein the protrusions protrude in the pushing direction, the protrusions being closer together toward one side in the thickness direction when viewed from a direction orthogonal to the pushing direction and the thickness direction.

3. The blade according to claim 1, wherein the plurality of protrusions are disposed so that an amount of protrusion becomes larger toward the pushing direction, the protrusions being closer together toward the center side in the thickness direction when viewed from the direction orthogonal to the pushing direction and the thickness direction.

4. The blade according to claim 1, wherein the plurality of protrusions are disposed so that an amount of protrusion becomes larger toward the pushing direction, the protrusions being closer together toward the one side in the thickness direction when viewed from the direction orthogonal to the pushing direction and the thickness direction.

5. The blade according to claim 1, wherein the blade comprises a laminate in which a plurality of protrusion plates having the protrusions are stacked in the thickness direction.

6. The blade according to claim 1, wherein a plurality of convex portions protruding in the pushing direction of the blade and arranged in a direction orthogonal to the pushing direction and the thickness direction are provided on the edge of the folding side of the sheet in the protrusion portion.

7. The blade according to claim 1, wherein a concave portion recessed on a side opposite to the pushing direction of the blade is provided at the edge of the folding side of the sheet in the blade so as to avoid a folding roller.

8. The blade according to claim 1, wherein a protrusion amount of the protrusion is equal to or greater than a distance between a protrusion end and a first base end in the pushing direction.

9. A post-processing apparatus that performs post-processing on a sheet, the apparatus comprising:

the blade according to claim 1.

10. The post-processing apparatus according to claim 9, further comprising:

a pair of folding rollers configured to nip the sheet pushed by the blade.

11. A saddle folding method for saddle-folding a sheet, comprising:

pushing a blade comprising a protrusion portion that protrudes in a pushing direction of the blade on an edge of a folding side of the sheet between a pair of folding rollers, wherein the blade comprises a plurality of protrusions aligned in a thickness direction of the blade, and the plurality of protrusions engage the folding side of the sheet when pushing the blade; and pushing the blade comprising protrusions closer together toward a center side in the thickness direction when viewed from a direction orthogonal to a pushing direction and the thickness direction.

12. The saddle folding method according to claim 11, further comprising:

pushing the blade comprising protrusions closer together toward one side in the thickness direction when viewed from a direction orthogonal to a pushing direction and the thickness direction.

13. The saddle folding method according to claim 11, further comprising:

pushing the blade comprising protrusions disposed so that an amount of protrusion becomes larger toward a pushing direction, the protrusions being closer together toward the center side in the thickness direction when viewed from a direction orthogonal to the pushing direction and the thickness direction.

14. The saddle folding method according to claim 11, further comprising:

pushing the blade comprising protrusions disposed so that an amount of protrusion becomes larger toward a pushing direction, the protrusions being closer together toward the one side in the thickness direction when viewed from a direction orthogonal to the pushing direction and the thickness direction.

15. A blade for a saddle folding unit that facilitates saddle-folding a sheet, the blade comprising:

a protrusion portion that protrudes in a pushing direction of the blade on an edge of a folding side of the sheet in the blade, wherein the protrusion portion comprises a plurality of protrusions aligned in a thickness direction of the blade, and wherein the protrusions protrude in the pushing direction, the protrusions being closer together toward one side in the thickness direction when viewed from a direction orthogonal to the pushing direction and the thickness direction.

16. The blade according to claim 15, wherein a plurality of convex portions protruding in the pushing direction of the blade and arranged in a direction orthogonal to the pushing direction and the thickness direction are provided on the edge of the folding side of the sheet in the protrusion portion.

17. The blade according to claim 15, wherein a concave portion recessed on a side opposite to the pushing direction of the blade is provided at the edge of the folding side of the sheet in the blade so as to avoid a folding roller.

18. The blade according to claim 15, wherein a protrusion amount of the protrusion is equal to or greater than a distance between a protrusion end and a first base end in the pushing direction.

19. A post-processing apparatus that performs post-processing on a sheet, the apparatus comprising:

the blade according to claim 15.

* * * * *